United States Patent [19]

Okojima et al.

[11] Patent Number: 4,799,604

[45] Date of Patent: Jan. 24, 1989

[54] VANITY CASE

[75] Inventors: Sumio Okojima, Inba; Yukitomo Yuhara, Abiko, both of Japan

[73] Assignee: Yoshida Industry Co., Ltd., Tokyo, Japan

[21] Appl. No.: 81,733

[22] Filed: Aug. 5, 1987

[51] Int. Cl.[4] ..... A45D 40/00; B65D 45/00

[52] U.S. Cl. ..... 220/260; 220/326; 220/335

[58] Field of Search ..... 132/79 R, 83; 220/315, 220/326

[56] References Cited

U.S. PATENT DOCUMENTS 4,483,355 11/1984 Yuhara ..... 132/83 R 4,595,028 6/1986 Yuhara ..... 132/79 R

*Primary Examiner*—Allen M. Ostrager

*Attorney, Agent, or Firm*—Wenderoth, Lind & Ponack

[57] ABSTRACT

A vanity case comprising a receptacle member, a cover member hinged at its rear end with the receptacle member, a first latch member, a second latch member formed on the cover member for engagement with the first latch member whereby the cover member is maintained in a closed position with respect to the receptacle member, and an unlatch member movably secured in the receptacle member and including a pull member having an end portion extending beyond the wall of the receptacle member, the unlatch member further including means for, upon its movement by drawing the pull member, releasing engagement between the first and second latch members.

15 Claims, 10 Drawing Sheets

VANITY CASE

BACKGROUND OF THE INVENTION

1. Field of the Invention

The present invention relates to a vanity case for use in make-up and, more particularly, to an improvement in an unlatch mechanism of a vanity case in which a cover member is hinged with a receptacle member and is maintained in a closed position by engagement between a pair of latch members.

2. Description of Prior Art

A typical vanity case has the latch members formed at the front ends of receptacle and cover members of which engagement is manually released by pushing up the front end of cover member with a user's finger while holding the receptacle member by the other hand. Thus, the latch members must have a dimentional accuracy in order to ensure the release of engagement with a relatively small force and to prevent an accidental opening of the cover member. This severe requirement in the latch members has, however, resulted in a poor production efficiency.

A vanity case having an unlatch mechanism is disclosed in, for example, U.S. Pat. No. 4,331,168. The unlatch mechanism therein comprises a slider element which is slidably received in the front end of the cover member and includes a slant surface positioned closely adjacent to the receptacle member. When the outer end of the slider element is pushed inwardly, the slant surface forces the receptacle member away from the cover member to release the engagement between the latch members. Also, U.S. Pat. No. 4,399,826 discloses a vanity case in which an unlatch member is formed to a L-shape and pivotably secured in a recess formed in the receptacle or cover, in such a manner that one end of the unlatch member forces the cover away from the receptacle to release the engagement when the unlatch member pivots about the corner thereof by pressing the other end thereof inwardly. Further, U.S. Pat. No. 4,580,586 discloses an unlatch mechanism of a vanity case comprising a pair of sliding pieces having enlarged inner ends to catch therebetween the latch member of the cover. The sliding pieces are received in the receptacle to move in the transverse direction and are combined together in the opposite directions so that they are urged by a spring to normally project the outer end from the side walls of the receptacle. When these outer ends are pushed inwardly, the enlarged inner ends moves away from each other to release the latch member.

In all of the above-discussed vanity cases, the cover member is opened when the unlatch member is pushed or pressed inwardly. The inwardly directed pressure may, however, be accidentally exerted onto the vanity case particularly when it is carried about in a handbag and the like, resulting in an unnecessary and undesirable opening of the cover member. Further, it has been found not so convenient to push the end portion of the unlatch member inwardly because the unlatch member actually is quite small for the user's finger. Additionally, the end portion of the unlatch member need be exposed outside of the vanity case, which narrows variety in external designs of the vanity case.

It is therefore an object of the present invention to provide a vanity case in which engagement between latch members can be released by a simple operation and with a small force while preventing any accidental opening of a cover member.

Another object of the invention is to provide a vanity case having an unlatch mechanism which may be easily operated by a user's finger.

A still another object of the invention is to provide a vanity case which may increase variety in an external appearance.

SUMMARY OF THE INVENTION

According to the present invention, a vanity case includes a box-like receptacle member, a cover member hinged at the rear end thereof with the receptacle member, a first latch member, and a second latch member formed on the cover member and adapted to engage with the first latch member whereby the cover member is maintained in a closed position with respect to the receptacle member. Movably secured in the receptacle member is unlatch means which includes a pull member having an end portion extending beyond the wall of the receptacle member and means for, upon movement thereof by drawing the pull member, releasing engagement between the first and second latch members.

The engagement between the latch members can be released simply by drawing the pull member. Since a pull force is hardly applied to the vanity case except for an intentional operation by a user, an accidental opening of the cover member can be effectively prevented.

Preferably, the pull member is formed separately from and is attached to the unlatch means and comprises a thin, pliable element selected from a group of chain, string and cord.

In one embodiment of the invention, the unlatch means comprises a slide member disposed on the bottom of the receptacle member and slidable in the transverse direction of the receptacle member. The first latch member may be formed on the receptacle member and the engagement releasing means may comprise a slant surface formed on the slide member. Alternatively, the first latch member may be provided on the slide member which, upon movement, shifts the first latch member away from the second latch member to release the engagement.

In another embodiment of the invention, the unlatch means comprises an angle member pivotably secured in the receptacle member, the pull member being connected to the angle member in such a manner as to cause the angle member to pivot when the pull member is drawn. The engagement releasing means may comprise one end of the angle member which is positioned closely adjacent to the lower end of the cover member in the closed position thereof.

Other objects, features and advantages of the present invention will be apparent from the following detailed description thereof when taken in conjunction with the accompanying drawings.

DETAILED DESCRIPTION OF THE INVENTION

Figure 1:
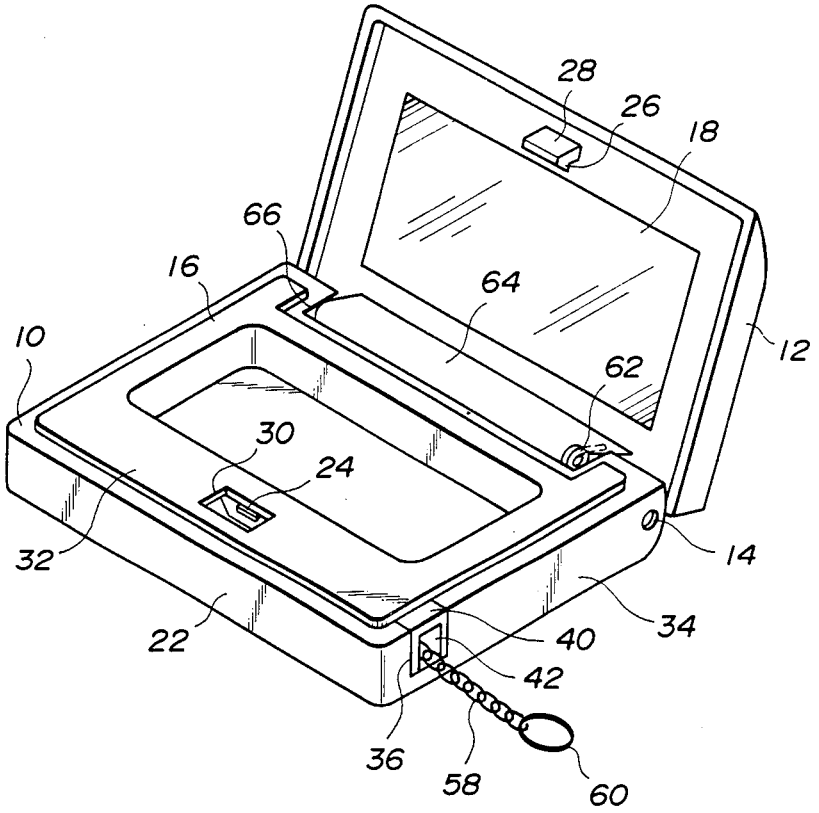
FIG. 1 is a perspective view illustrating a vanity case according to an embodiment of the invention, with a cover member being opened.
Figure 2:
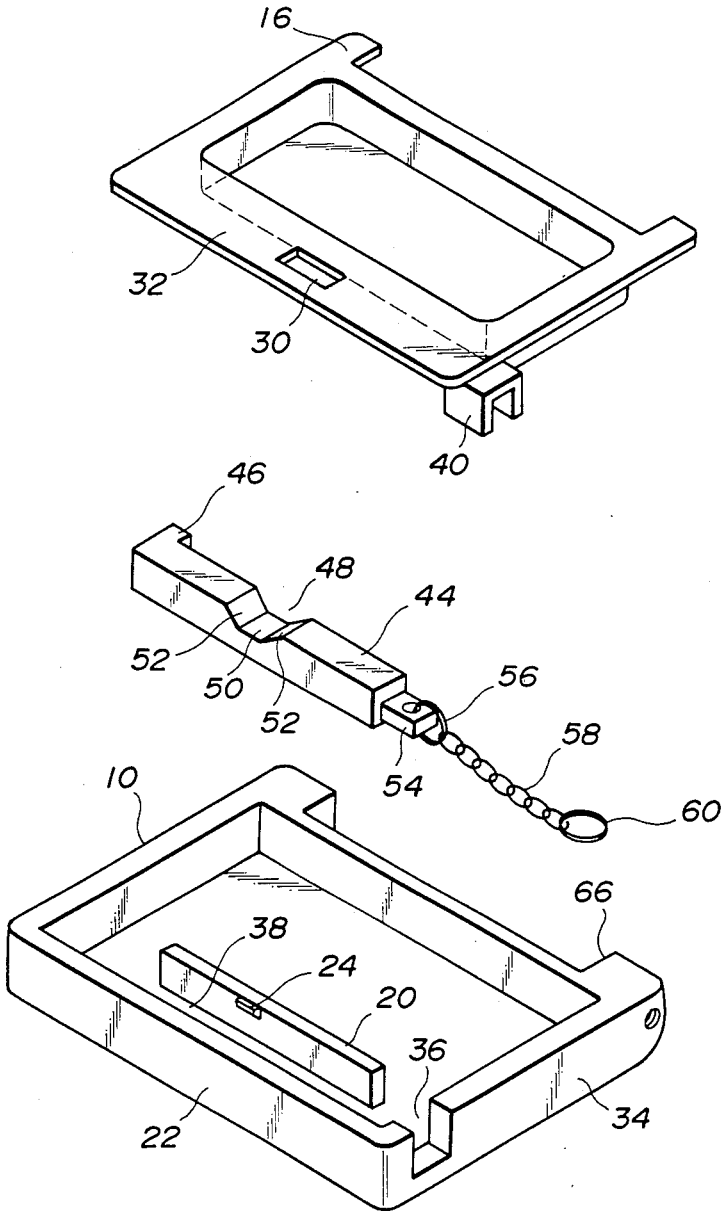
FIG. 2 is an exploded perspective view illustrating various parts of the vanity case in FIG. 1.
Figure 3B:
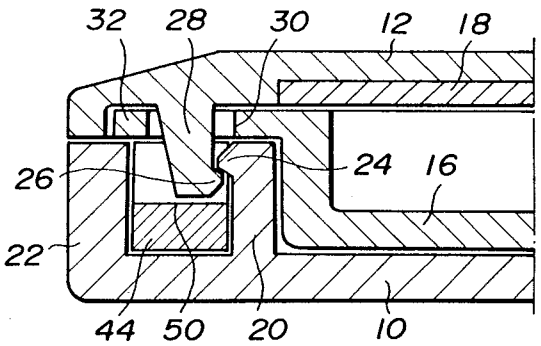
FIGS. 3A and 3B are transverse and longitudinal sectional views respectively of the vanity case in FIG. 1, with latch members engaging each other.
Figure 3A:
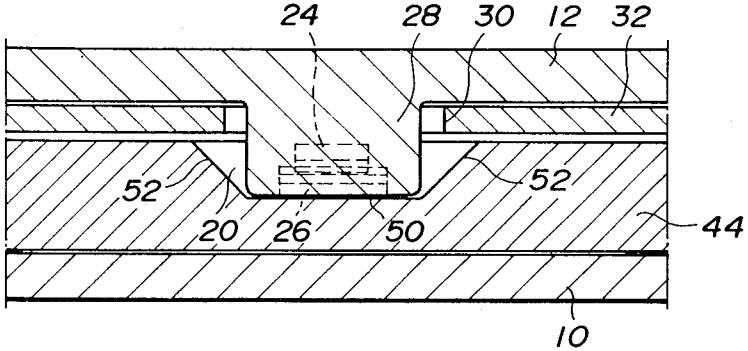

Referring first to FIGS. 1 to 4 of the drawings, a vanity case according to an embodiment of the invention comprises a box like receptacle 10 and a cover 12 hinged with the receptacle 10 at the respective rear ends by means of a pin 14. A tray 16 for containing cosmetic material is housed within the receptacle 10, while a mirror 18 is attched to the lower surface of the cover 12. A laterally elongated projection 20 extends up from the bottom of receptacle 10 and is spaced from the front wall 22 of receptacle 10 in parallel therewith. The projection 20 has at the upper central portion thereof a first latch 24 adapted to engage with a second latch 26 which is formed at a lower end of a nose 28 extending down from the lower surface of cover 12, so that the cover 12 can be maintained in a closed position with respect to the receptacle 10 as shown in FIG. 3. A rectangular opening 30 is formed in a front flange 32 of the tray 16 to permit the nose 28 to enter into the receptacle 10 for engagement between the latches 24 and 26. The right-hand side wall 34 of the receptacle 10 is recessed at 36 in alignment with a space 38 defined between the projection 20 and the front wall 22. The flange 32 of tray 16 is provided at the lower surface thereof with a downwardly opened channel piece 40 which is fitted in the recess 36 to define a passage 42.

A slide member 44 is fitted in the space 38 such that the member 44 can move in the lateral direction of the receptacle 10, and is in the form of a bar having a substantially square cross section. The left-hand end of the slide member 44 is slightly projected rearwardly to provide a stopper 46 which, upon sliding movement of the bar toward the side wall 34, engages with the left-hand edge of the projection 20 to limit the movement. The upper surface of slide member 44 is centrally recessed to form a depression 48 which is defined by a flat bottom surface 50 and a pair of slant surfaces 52-52 inclined outwardly toward the upper surface. The depression 48 is arranged such that when the cover 12 is in the closed position, the nose 28 is between the slant surfaces 52-52 and its lower end is closely adjacent to the bottom surface 50, as shown in FIG. 3.

The end of slide member 44 opposite to the stopper 46 includes a bracket 54 having an aperture for attaching a ring 56. Pull means comprising, in the illustrated embodiment, a slender chain 58 is linked at one end thereof to the ring 56 and extends laterally through the passage 42 to expose its other end outside of the receptacle 10. Another ring 60 is linked to the other end of the chain 58 for the purpose of facilitating a pulling operation as described below and also for improving the appearance. If desired, the pull means may comprise a string, cord and the like. Alternatively, the pull means may be a pole or a projection formed integrally with the slide member 44. If the pull means is rigid, a suitable stopper means need be provided on the receptacle 10 or the tray 16 to prevent the slide member 44 from moving left when the pull means is somehow pressed inwardly. As the pull means a metallic chain is preferable because of its ornamental nature.

A coil spring 62 is attached around the hinge pin 14 in such a manner that its one end abuts against a hinge block 64 of the cover 12 and its other end against an inner wall defining a hinge recess 66 of the receptacle 10. By this spring 62 the cover 12 is urged to the open position of FIG. 1.

Figure 4B:
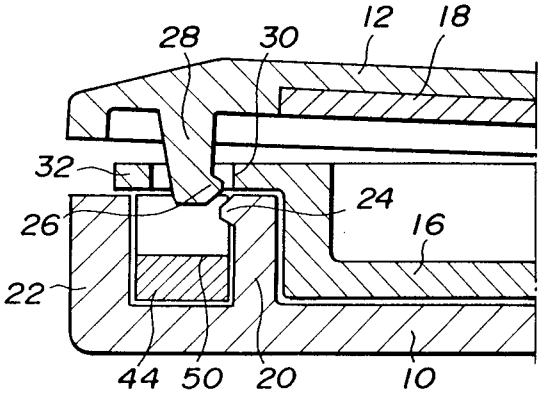
FIGS. 4A and 4B are views similar to FIGS. 3A and 3B, respectively, with the engagement being released.
Figure 4A:
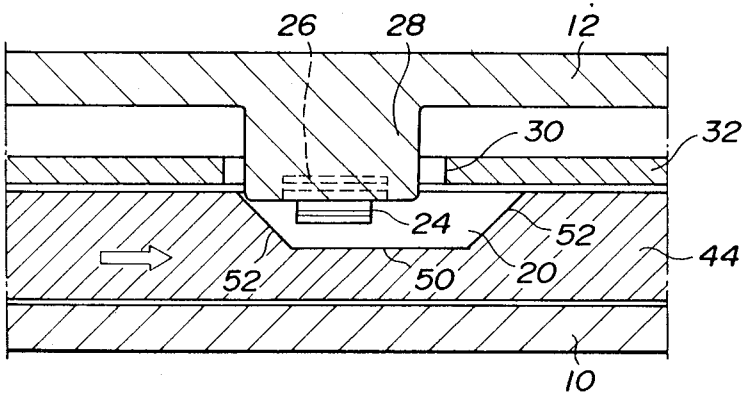
Figure 5:
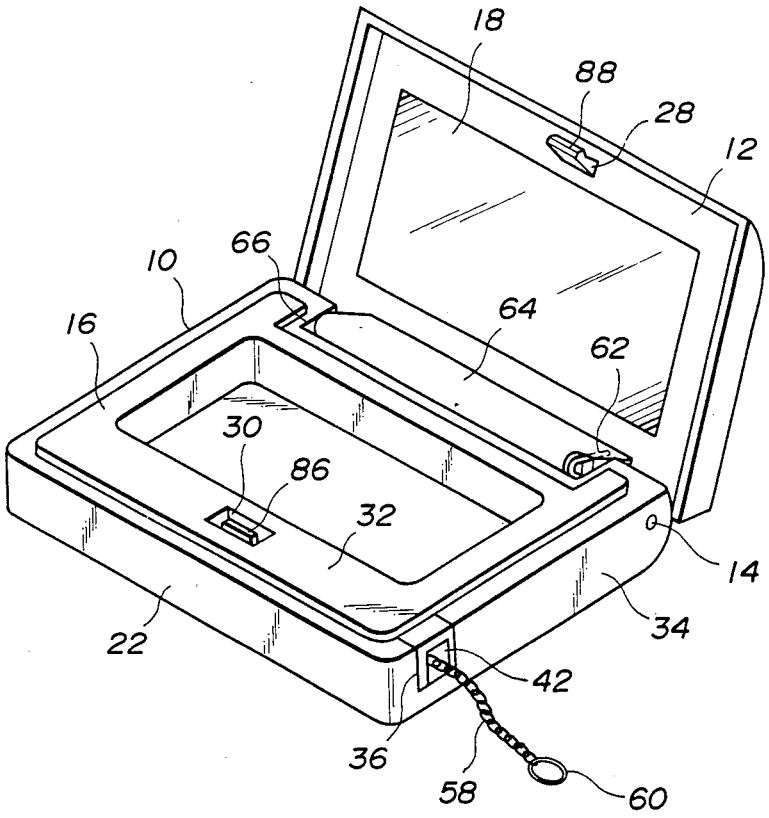
FIG. 5 is a perspective view of a vanity case according to another embodiment of the invention.
Figure 6:
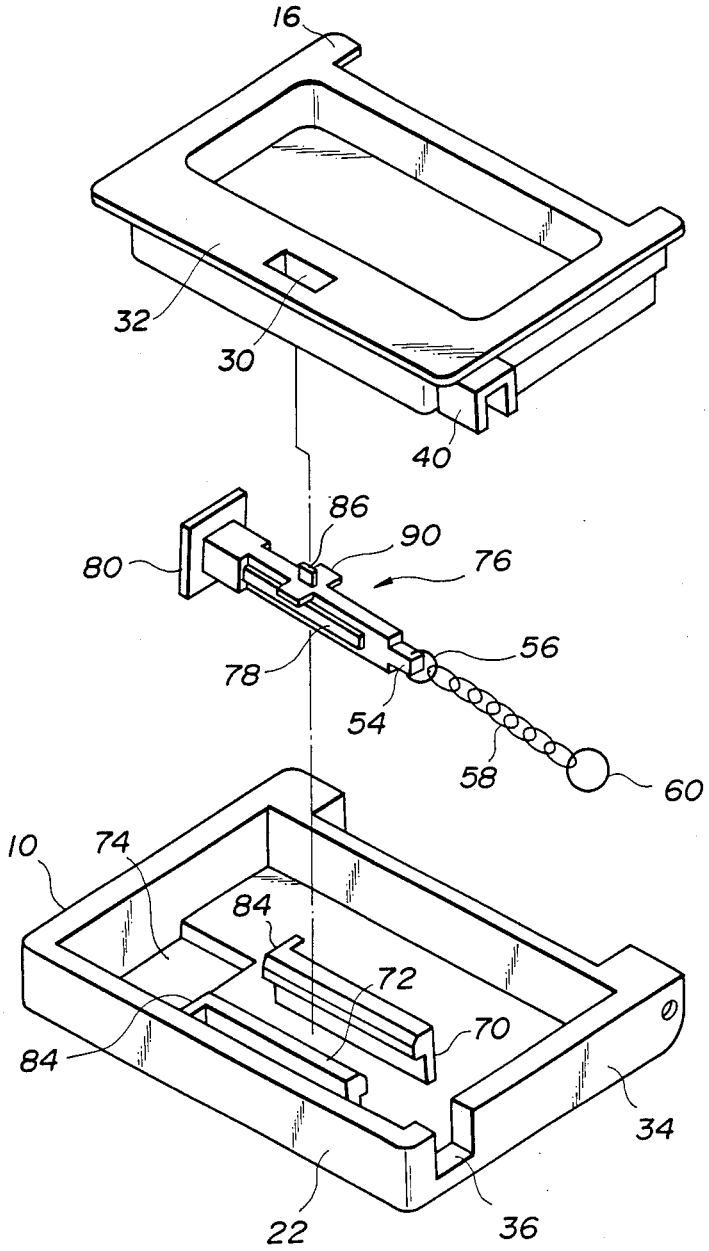
FIG. 6 is an exploded perspective view showing various parts of the vanity case in FIG. 5.

Assuming that the cover 12 is in the closed position over the receptacle 10 through the engagement of latches 24 and 26 as shown in FIG. 3, when the chain 58 is pulled outwardly by drawing the ring 60 away from the receptacle 10, the slide member 44 is moved toward the side wall 34. During such a movement, the left-hand slant surface 52 abuts against the lower edge of the nose 28 and forces up the latter. Therefore, the second latch 26 is released from the engagement with the first latch 24 as shown in FIG. 4, and the cover 12 is automatically opened to a desired angle by the spring 62. It is to be noted here that once the latches are disengaged from each other, a gap is defined between the front ends of the cover 12 and the receptacle 10, permitting a user to manually lift up the cover 12. Accordingly, the provision of spring 62 is preferable but it may be omitted.

Reference is now made to FIGS. 5 to 9 showing another embodiment of the invention, in which the same or corresponding parts are designated by the same reference numerals. In this embodiment, the receptacle 10 has a pair of projections 70—70 having enlarged upper ends 72—72 facing each other and a groove 74 which is positioned adjacent to the left-hand side wall of the receptacle. A slide member 76 is fitted between the projections 70 such that its sliding movement is guided by the enlarged upper ends 72 in cooperation with bulges 78 of the slide member 76. A thin plate 80 is provided at the end of the slide member opposite to the bracket 54 and is placed in the groove 74 to receive one end of a compression spring 82. The other end of the spring 82 abuts against flanges 84 of the projections 70, so that the slide member 76 is urged left and maintained in a position of FIG. 8. A first latch 86 projects from the upper surface of the slide member 76 to engage with a second latch 88 of the nose 28. The slide member 76 also has transverse protrusions 90 which extend above the projections 70.

Figure 7:
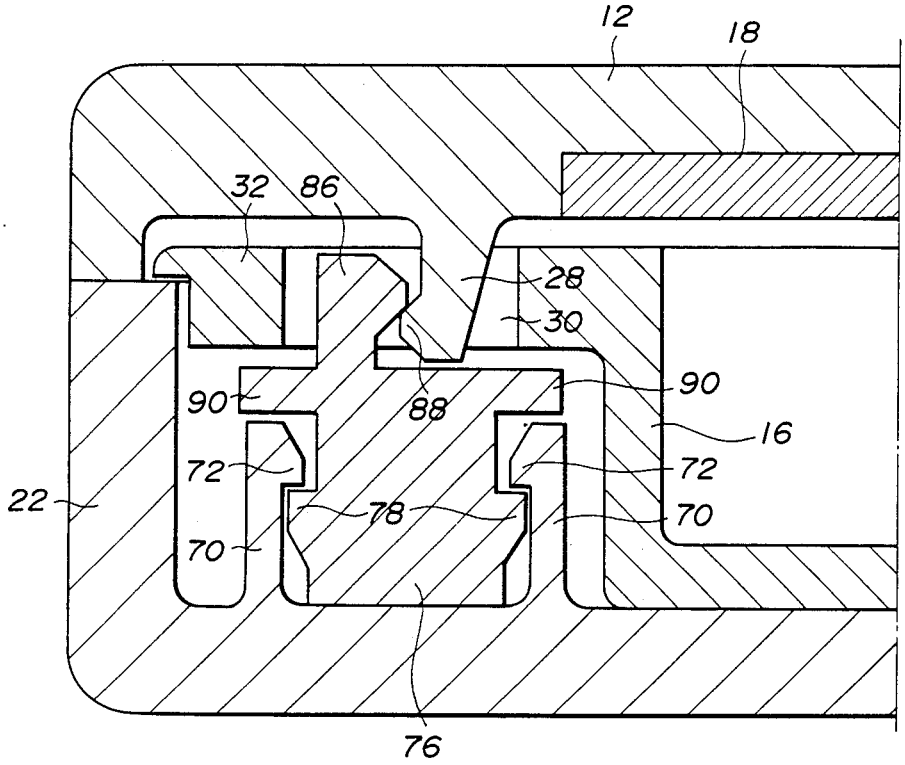
FIG. 7 is an enlarged sectional view of the vanity case in FIG. 5.
Figure 8A:
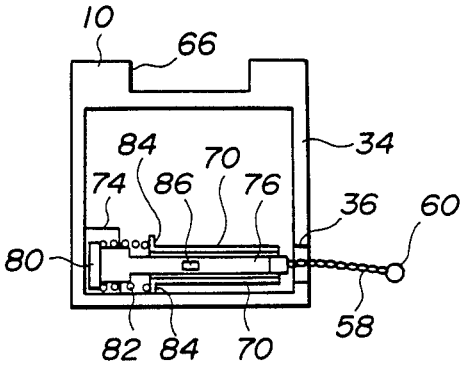
FIGS. 8A and 8B are schematic views showing arrangement of a slide member and latch members in an engaged position of FIG. 7.
Figure 8B:
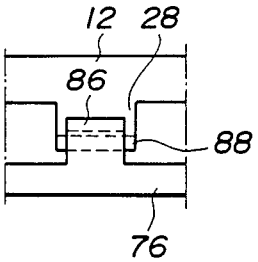
Figure 9A:
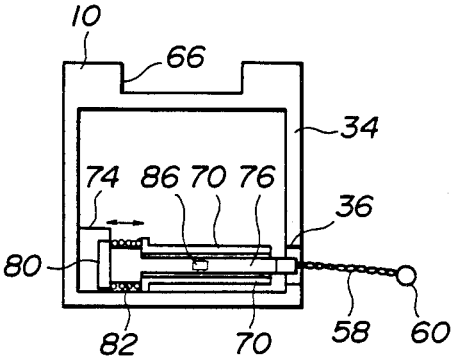
FIGS. 9A and 9B are views similar to FIGS. 8A and 8B, respectively, showing a released position of the latch members.
Figure 9B:
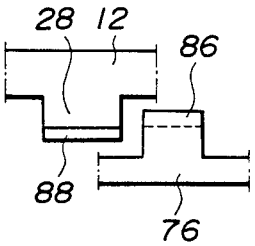
Figure 10:
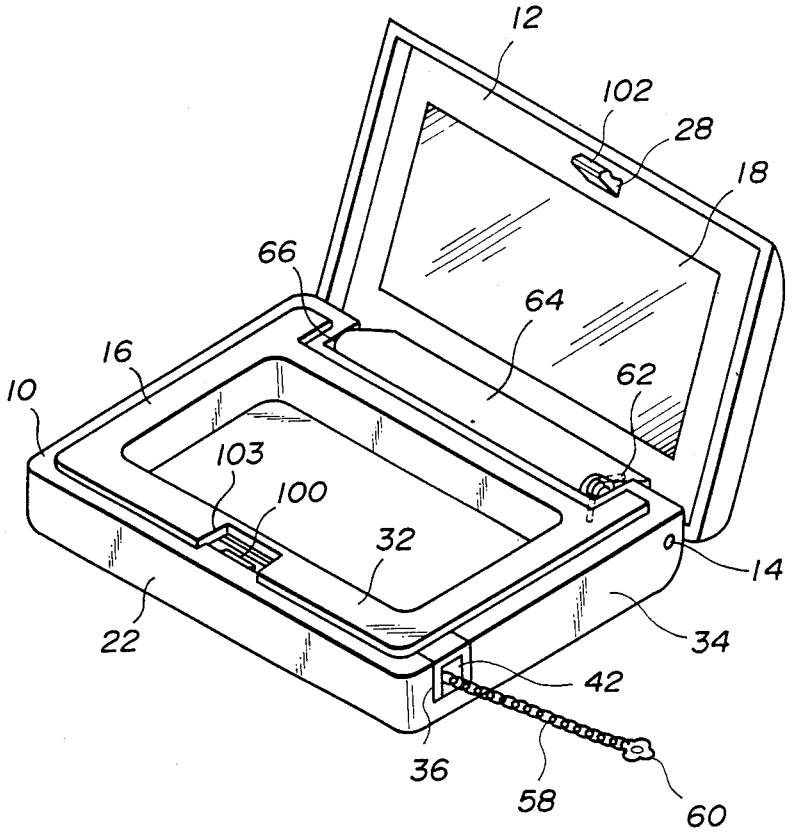
FIG. 10 is a perspective view illustrating a vanity case according to a still another embodiment of the invention.
Figure 11:
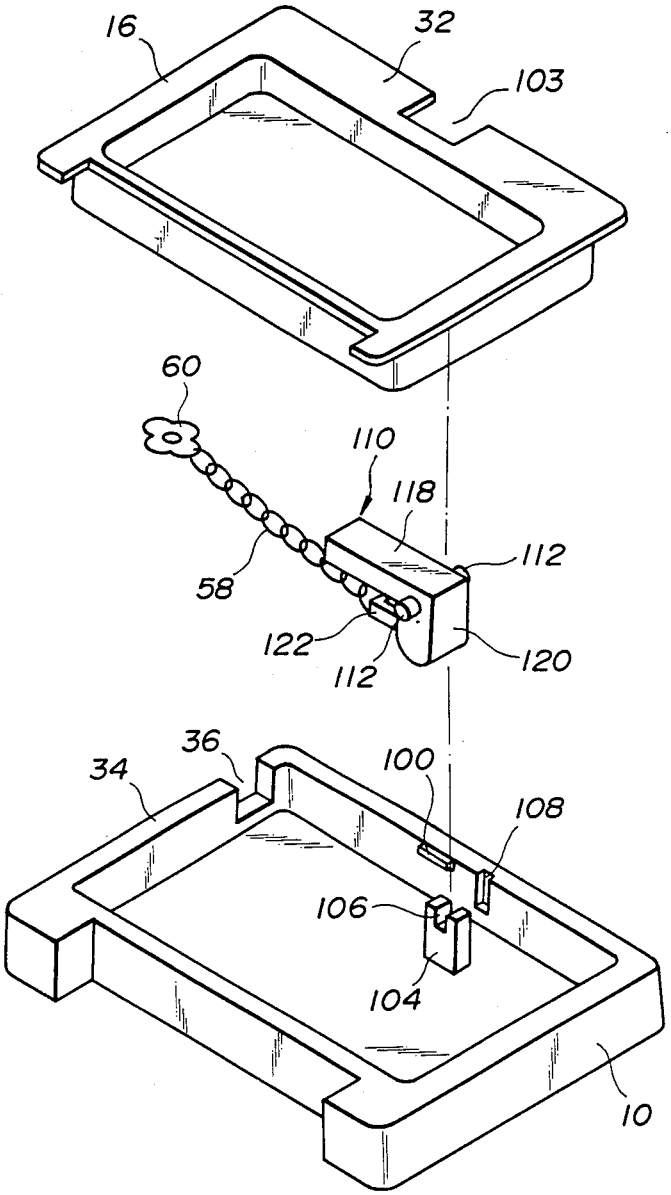
FIG. 11 is an exploded perspective view showing various parts of the vanity case in FIG. 10.
Figure 12:
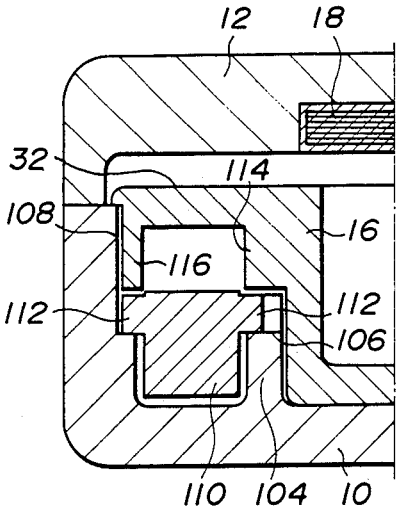
FIG. 12 is a sectional view showing arrangement of an angle member and a tray of the vanity case in FIG. 10.

As shown in FIGS. 7 and 8, the cover 12 is closed over the receptacle 10 by the engagement of latches 86 and 88. When the chain 58 is pulled outwardly, the slide member 76 is moved toward the side wall 34 against the elastic force of the spring 82. The first latch 86 is therefore displaced together with the slide member 76 and the second latch 88 is released from the engagement, thus permitting the cover 12 to open either by the coil spring 62 as in the illustrated embodiment or manually. After the pull force to the chain 58 is removed, the slide member 76 returns to its normal position by the spring 82.

A further embodiment of the invention is illustrated in FIGS. 10 through 14 in which the same or corresponding parts as in the first embodiment are also designated by the same reference numerals. The receptacle 10 is provided on the inner surface of the front wall 22 with a first latch 100 adapted to engage with a second latch 102 on the nose 28 of the cover 12. Formed in the front flange 32 of the tray 16 is a recess 103 to permit the nose 28 to enter into the receptacle 10. A projection 104 extends up from the bottom of receptacle 10 at a position laterally away from the latch 100 and spaced from the front wall 22. The upper end of the projection 104 has a groove 106 which faces a slot 108 formed in the inner surface of the front wall 22.

An angle member 110 having a pair of bosses 112—112 at a corner thereof is pivotably secured within the receptacle 10 by fitting the bosses 112—112 into the groove 106 and slot 108 respectively. As seen from FIG. 12, the front flange 32 of the tray 16 has a thickened portion 114 hanging over the projection 104 and a downward extension 116 fitted within the slot 108 so as to hold the bosses 112 in position. The angle member 110 includes a horizontal end 118 which extends in a plane slightly below the latch 100 and a vertical end 120 from which a bracket 122 is laterally projected to connect the chain 58. The bracket 122 extends below the horizontal end 118 in parallel therewith so that when the chain 58 is pulled outwardly, the angle member 110 may rotate in the counterclockwise direction in FIG. 13B around the axis formed by the bosses 112. The horizontal end 118 is arranged such that its upper surface is closely adjacent to the lower end of the nose 28 when the cover 12 is maintained in the closed position by the latches 100 and 102.

Figure 13A:
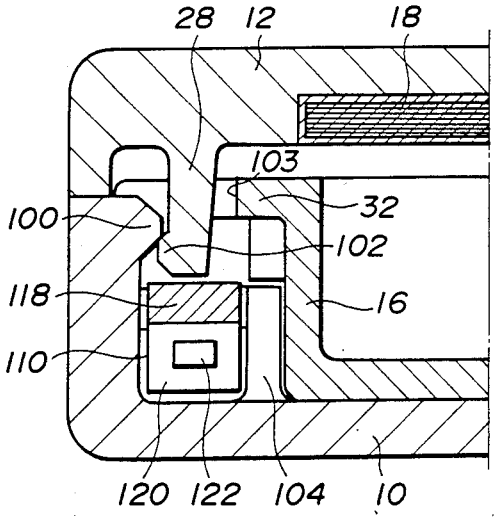
FIGS. 13A and 13B are longitudinal and transverse sectional views, respectively, of the vanity case in FIG. 10 with latch members engaging each other.
Figure 13B:
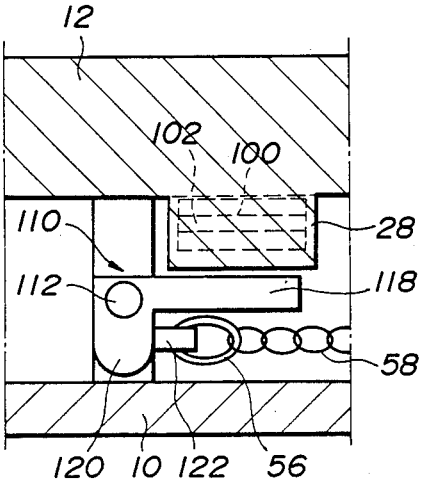
Figure 14:
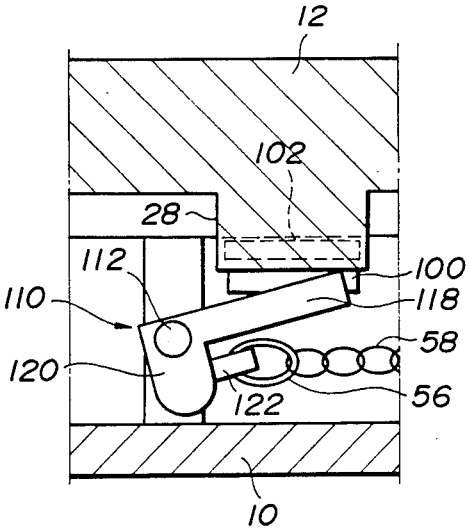
FIG. 14 is a view similar to FIG. 13B showing an operation of the angle member.

In FIG. 13, the cover 12 is in the closed position. When a user wishes to open the cover 12, the chain 58 is pulled outwardly by drawing the ring 60 which is exposed outside the receptacle 10. This causes the angle member 110 to rotate around the axis whereby the horizontal end 118 abuts against the lower end of the nose 28 to force up the latter. Therefore, the second latch 102 is released from engagement with the first latch 100, and the cover 12 can be opened to a desired angle.

As it could be understood from the foregoing description, the engagement between the latches can be released simply by pulling the chain or other pull means away from the receptacle. The pull means extends beyond the wall of receptacle, which facilitates holding the pull means by fingers. Further, an accidental opening of the cover can be prevented because the pull force is hardly applied to the vanity case in a handbag and the like.

Although the present invention has been described with reference to the preferred embodiments thereof, many modifications and alterations may be made within the spirit of the invention.

What is claimed is:

1. A vanity case comprising:

a box-like receptacle member;

a cover member hinged at the rear end thereof with said receptacle member;

a first latch member;

a second latch member formed on said cover member and adapted to engage with said first latch member whereby said cover member is maintained in a closed position with respect to said receptacle member; and unlatch means movably secured in said receptacle member and including a pull member having an end portion extending beyond the wall of said receptacle member, and said unlatch means also including means for, upon movement thereof by drawing said pull member, releasing engagement between said first and second latch members.

2. A vanity case as claimed in claim 1, wherein said unlatch means comprises a slide member disposed on the bottom of said receptacle member and slidable in the transverse direction of said receptacle member.

3. A vanity case as claimed in claim 2, further comprising an elongated projection extending up from the bottom of said receptacle member for guiding the movement of said slide member, and wherein said first latch member is formed on the upper end of said projection.

4. A vanity case as claimed in claim 3, wherein said slide member has formed on the upper surface thereof a depression defined by at least one slant surface, the lower end of said cover member being positioned closely adjacent to said slant surface when said cover member is in said closed position, and wherein said engagement releasing means comprises said slant surface which, upon movement of said slide member, forces up said cover member.

5. A vanity case as claimed in claim 2, wherein said first latch member is integrally formed on said slide member, and said engagement releasing means comprises a body of said slide member which, upon movement thereof, shifts said first latch member away from said second latch member.

6. A vanity case as claimed in claim 5, further comprising spring means for normally maintaining said slide member to a position where said first latch member is engageable with said second latch member.

7. A vanity case as claimed in claim 1, wherein said unlatch means comprises an angle member pivotably secured in said receptacle member, and said pull member is connected to said angle member in such a manner as to cause said angle member to pivot when said pull member is drawn.

8. A vanity case as claimed in claim 7, wherein said first latch member is formed on said receptacle member and one end of said angle member is positioned closely adjacent to the lower end of said cover member, and wherein said engagement releasing means comprises said one end of said angle member which, upon pivotting, forces up said cover member.

9. A vanity case as claimed in claim 1, wherein said pull member is formed separately from and is attached to said unlatch means.

10. A vanity case as claimed in claim 9, wherein said pull member comprises a thin, pliable element selected from a group of chain, string and cord.

11. A vanity case as claimed in claim 1, wherein said pull member is formed integrally with said unlatch means.

12. A vanity ase as claimed in claim 1, wherein said receptacle member has formed in the side wall thereof a recess through which said end portion of said pull member extends outwardly.

13. A vanity case as claimed in claim 12, further comprising a tray fitted in said receptacle member for containing cosmetic material therein, said tray including a channel piece fitted in said recess to define a passage for said pull member.

14. A vanity case as claimed in claim 1, further comprising elastic means for urging said cover member to the open position.

15. A vanity case as claimed in claim 14, wherein said elastic means comprises a coil spring fitted around a hinge pin.

* * * * *